United States Patent [19]

Takeuchi

[11] Patent Number: 4,887,964

[45] Date of Patent: Dec. 19, 1989

[54] IMAGE FIXING ROLLER AND IMAGE FIXING APPARATUS USING SAME

[75] Inventor: Tatsuo Takeuchi, Kawasaki, Japan

[73] Assignee: Canon Kabushiki Kaisha, Tokyo, Japan

[21] Appl. No.: 216,234

[22] Filed: Jul. 7, 1988

[30] Foreign Application Priority Data

Jul. 10, 1987 [JP] Japan ..... 62-170863
Jul. 10, 1987 [JP] Japan ..... 62-170864

[51] Int. Cl.[4] ..... F27B 9/28

[52] U.S. Cl. ..... 432/60; 219/216; 219/469; 355/284; 355/290; 432/8

[58] Field of Search ..... 355/3 FU; 432/60, 8; 219/469, 216

[56] References Cited

U.S. PATENT DOCUMENTS

| | | | |
|---|---|---|---|
| 4,127,764 | 11/1978 | Minden | 219/216 |
| 4,150,181 | 4/1979 | Smith | 432/60 |
| 4,200,389 | 4/1980 | Matsui et al. | 355/3 FU |
| 4,207,059 | 6/1980 | Gaitten et al. | 219/469 |
| 4,223,203 | 9/1980 | Elter | 219/216 |
| 4,518,655 | 5/1985 | Henry et al. | 432/60 |
| 4,540,267 | 9/1985 | Moser | 355/3 FU |

*Primary Examiner*—Henry C. Yuen

*Attorney, Agent, or Firm*—Fitzpatrick, Cella, Harper & Scinto

[57] ABSTRACT

An image fixing apparatus includes a couple of rotatable rollers press-contacted to each other, for fixing a toner image by passing a toner image carrying material carrying the toner image, through a nip formed between the rotatable rollers, at least one of the rollers including a surface coating of anodized aluminum having fine pores filled with perfluoroalkyl compound material.

37 Claims, 3 Drawing Sheets

IMAGE FIXING ROLLER AND IMAGE FIXING APPARATUS USING SAME

FIELD OF THE INVENTION AND RELATED ART

The present invention relates to an image fixing roller and an image fixing apparatus using the same for fixing an unfixed toner image, usable with an electrophotographic or electrostatic recording apparatus or the like.

A roller image fixing apparatus using a couple of rollers is widely used in the field of an image fixing apparatus for fixing an unfixed toner image, since it is advantageous from the standpoint of reducing the size of the apparatus and others. Among the roller fixing apparatuses, a heating roller type fixing apparatus is mainly used, since it is advantageous in the quality of the image and image fixing performance.

In the heating roller type fixing apparatus, a toner image carrying material carrying thereon an unfixed toner image, such as a transfer sheet, is passed through a nip formed between a heated roller and a back-up or pressing roller press contacted to the heated roller to fix the toner image.

As for the materials of the rollers, the heating (heated) roller directly contactable with the toner image is made of a hollow aluminum cylinder having a surface layer of several tens microns thickness of a high parting property material such as fluorine resin (PFA, PTFE, for example) or the like; the pressing roller is made of a hollow metal cylinder of aluminum or stainless steel having a heat resistive rubber of several mm thickness of silicone, fluorine rubber or the like. With this structure, the image fixing operation is carried out under such conditions that the surface temperature of the heating roller is raised up to 180–200° C., that a nip width, which is a width of contact between the rollers in the circumferential direction, is 6 - ten and several mm and that the contact pressure is 5 - ten and several kg/cm$^2$. This method of image fixing is sufficient in that the toner image and the carrying material are sufficiently heated, and the toner image is sufficiently fused and fixed on the carrying material.

However, this conventional fixing apparatus involves a problem that the surface material of the heating roller, which is of fluorine resin material such as PFA or PTFE resin, is worn or peeled, due to contact of separation pawls thereto for the purpose of assuredly separating the toner image carrying material from the pressing roller, due to contact of a temperature sensor thereto and/or due to passage of the carrying material such as a sheet of paper. The problem is, in addition to the wearing and the deterioration in the image quality by the peeling, the requirement that the pressure of contact of the separating pawl to the roller has to be reduced to reduce the wearing, the reduction resulting in frequent occurrence of paper jam.

Therefore, it is desired that the wearing is reduced without decreasing the contact pressure of the separating pawl. U.S. Pat. Ser. No. 4,043,747 proposes that the positions of the contacts are gradually changed to reduce the wearing without producing the jam.

However, this results in a complicated structure of the apparatus. Additionally, a certain level of the wearing due to the passage of the sheet can not be avoided.

Japanese Laid-Open Pat. Application No. 23946/1977 proposes that a surface of a good thermal conductor is provided with pores having diameters of several tens - several thousands Angstroms, which pores are impregnated with off-set preventing material containing a fluorine resin to constitute an image fixing roller. However, good thermal conductor metals such as aluminum and copper generally have a lower hardness, and therefore, are easily damaged if separating pawls for preventing the sheet from wrapping around the roller are contacted thereto with a high pressure. This is not desirable from the standpoint of increasing the durability of the roller.

In addition, due to the good thermal conductivity of the surface of the roller, a large amount of heat is transferred to the image carrying material having the toner image at the time of the image fixing operation, with the result that the toner is fused more than necessary, thus producing a toner off-set, that is, the toner is deposited onto the fixing roller. Further, since the heat is very quickly removed from the fixing roller, it is difficult to continuously produce the images of good quality. Furthermore, a large amount of heat application to the sheet produces an unnecessary curling of the sheet, which leads to occurrence of sheet jam and difficulty in handing the sheet when plural images are to be formed on the same sheet, which requires the sheet to be refed.

SUMMARY OF THE INVENTION

Accordingly, it is a principal object of the present invention to provide an image fixing roller having a high surface hardness and a high durability.

It is another object of the present invention to provide an image fixing roller which has a good surface hardness and a good parting property, simultaneously.

It is a further object of the present invention to provide an image fixing roller wherein the heat transfer to the image carrying material is reduced.

It is a yet further object of the present invention to provide an image fixing apparatus wherein occurrences of toner off-set or the curling of the image carrying material are reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
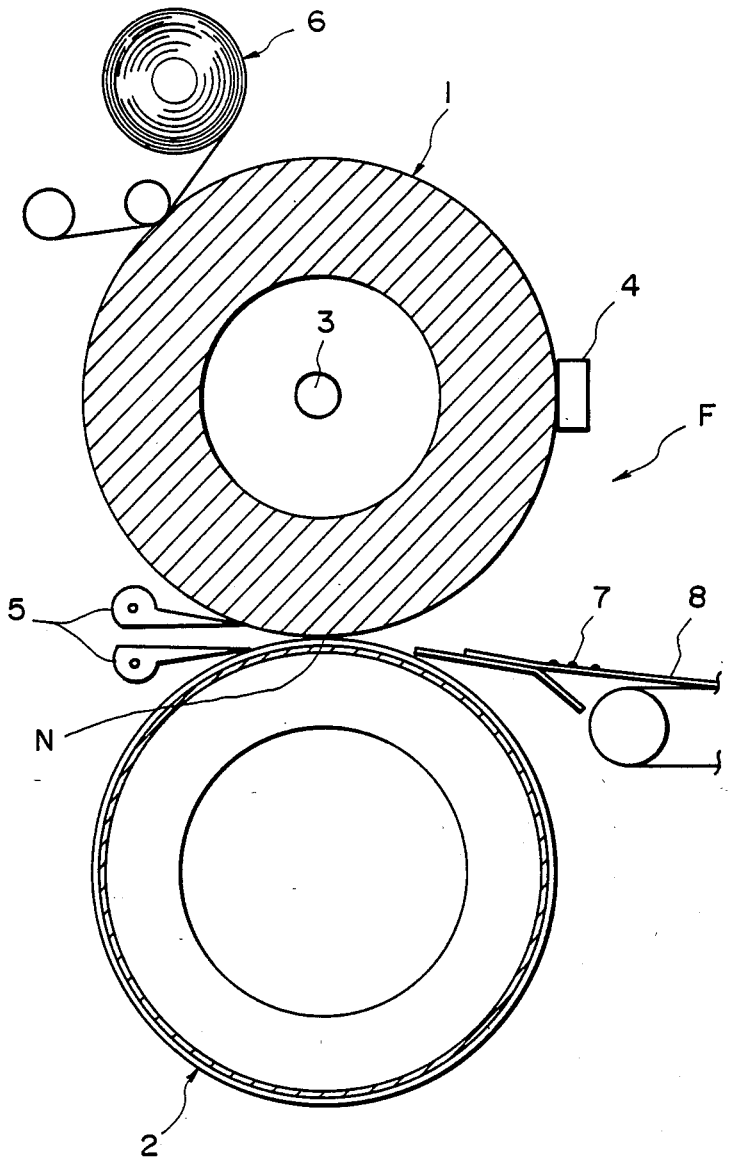
FIG. 1 is a sectional view of an image fixing apparatus according to an embodiment of the present invention.

The preferred embodiments of the present invention will be described in detail in conjunction with the accompanying drawings, wherein the same reference numerals or characters are assigned to the elements having the corresponding functions.

Referring to FIG. 1, an image fixing apparatus according to an embodiment of the present invention is shown. The image fixing apparatus comprises a heating roller 1, a pressing roller 2, a separating pawls 5 and a parting agent applying means 6.

The heating roller 1 is provided therein with a heating source 3 such as a halogen heater or the like for heating the heating roller 1. The surface temperature of the heating roller 1 is detected by a temperature sensor 4 such as a thermister which is contacted to the outer periphery of the heating roller. In response to the output of the temperature sensor 4, a temperature control device not shown effects on-off control to the inside heating source 3 to provide a substantially constant surface temperature of the heating roller 1.

On the other hand, the pressing roller 2 is a rubber roller having an aluminum or steel core metal covered with a silicone rubber layer (RTV or LTV) of a thickness of several mm. The pressing roller 2 is press-contacted by an unshown spring or the like to the heating roller 1 to form a nip N. Through the nip N, an image carrying material 8 carrying an unfixed toner image formed by a known electrophotographic process or the like is passed, by which the toner image is fixed on the carrying material 8.

Figure 2A:
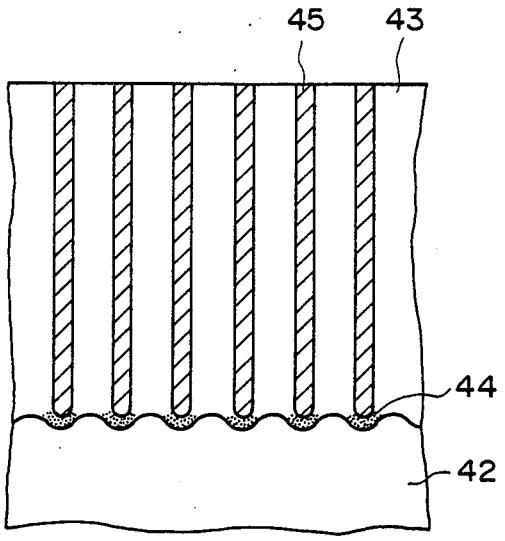
FIGS. 2A and 2B are enlarged sectional views of surface portions of the fixing rollers according to embodiment of the present invention.
Figure 2B:
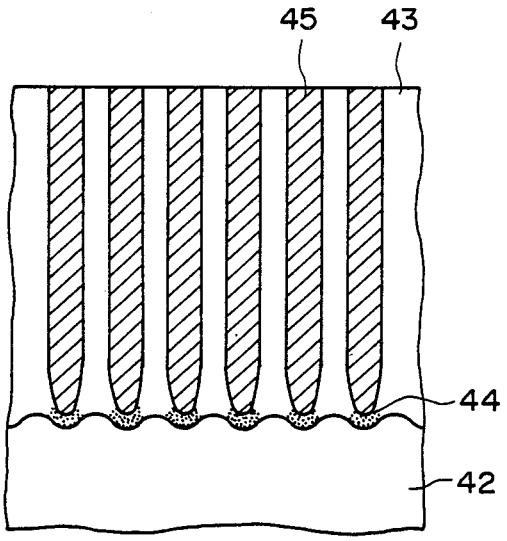

Referring to FIGS. 2A and 2B, the heating roller 1 will be described in detail, which Figures are sectional views of a surface part of the fixing roller 1. Referring first to FIG. 2A, a core metal 42 made of aluminum or aluminum alloy is anodized at its surface by a known anodizing method to form anodized surface oxide layer ($A1_2O_3$) 43, which will hereinafter be called "alumite" layer, having a thickness of several microns - several tens microns. Thereafter, a solid lubricant is filled into fine pores 45 existing in the alumite layer 43. The resultant product is shown in FIG. 2A. The fine pores 45 extend from the surface of the alumite layer substantially down to the aluminum core metal 42. At the interface between the aluminum core metal 42 and the alumite layer, there is an active layer (barrier layer 44). The diameter of the fine pores 45 differs depending on the liquid used in the anodizing treatment. The diameter is preferably 100–500 Angstroms, and the number of the pores is preferably such that 5–40 %, further preferably, 10–40 % of the anodized area of the aluminum surface is occupied by the pores. The treating liquid is selected in consideration of those desirabilities. For example, when the anodization is performed in 4 % phosphoric acid both at 24° C. by the voltage of 20 V, the diameter of the pores is 330 Angstroms, and the occupation of the pores is 16–18 %. When the alumite layer is produced by sulfuric acid treatment, which generally provides a hard coating, the diameter of the pores is 100–150 Angstroms, but the number of the pores can be increased by the voltage applied, and therefore, the occupation of 10–20 % can be obtained.

The anodized surface oxide layer produced in the manner described above is immersed in a mixture of water and anion or cation fluorine compound or in a mixture of water and isopropylalcohol or the like, and a DC or AC electric field is applied, placing the anodized aluminum roller as an electrode, by which the fluorine resin is accumulated in the pores 45 of the anodized coating from the bottom thereof. In this manner, the intended image fixing roller 1 can be provided. The fluorine resins usable for this purpose are perfluoroalkylphosphoric ester, perfluoroalkyl carboxylate, perfluoroalkyl ammonium salt and other perfluoro compound, which are generally called fluorine surface active agent. The perfluoroalkyl compound exhibits very good parting property when it is solidified.

In order to assure the durability of the heating roll 1, the fine pores 45 preferably has a thickness not less than 5 microns, and further preferably not less than 10 microns. Also, it is preferable that the fine pores in which the fluorine resin is substantially completely filled from the bottom to the top of the pores occupies 80 % or more of the total pores. However, if the depth of the fine pores 45 is not less than 50 microns, the hardness of the produced anodized coating decreases, and in addition, the number of fine pores not filled with the fluorine resin becomes large, and therefore, not practical.

In the foregoing embodiment, the heating roller having anodized coating or anodic oxidation coating is produced by a single electrolytic process.

Referring to FIG. 2B, there is shown another embodiment, wherein in order to increase the pore percentage, the coating is dissolved chemically after the anodic oxidation coating is formed. Alternatively, the pores can be expanded by electrolytic process using phosphoric acid bath, by which the amount of the fluorine resin filled can be increased. Further, the area where the fluorine resin is exposed at the outer surface increases, thereby improving the parting property. The perfluoroalkyl compound is generally poor in ductility, and therefore it is difficult that the entire surface of the heating roller is covered with the perfluoroalkyl compound. In consideration of this, the expansion of the fine pores is advantageous. However, the expansion of the pores results in decrease in the hardness of the anodic oxidation coating. For this reason, it is practically desirable that the pores are not expanded beyond two-fold or 2.5-fold.

As a further embodiment, the filler is not solely of the perfluoroalkyl compound, but fatty acid metallic salt or metallic sulfide exhibiting a water repelling property is added. Particularly, the former is excellent in the ductility which the perfluoroalkyl compound lacks, and therefore, is preferable to supplement the ductility. On the other hand, the fatty acid metallic salt has a low fusing temperature, and therefore, the mixture ratio with the perfluoroalkyl compound and the material thereof is property selected, depending on the temperature at which the heating roller is operated. More particularly, if it is constantly used above the temperature of 200° C., the content, in the mixture, of the perfluoroalkyl compound is preferably not less than 50 %, and the fatty acid metallic salt is preferably magnesium oleate or the like having a relatively high heat durability. For the temperature approximately 150° C., it is possible to use sodium stearate or the like. Usable fatty acid metallic salt will be mentioned. Particularly, magnesium salt, potassium salt and sodium salt or the like shows good water solubility, and therefore, are preferable from the standpoint of production cost. For example, there are potassium stearate, sodium stearate, potassium palmitate, sodium palmitate, magnesium oleate or the like.

Also, metallic sulfide, such as molybdenum disulfide or the like may be filled into the fine pores together with the perfluoroalkyl compound. In this case, the heat durability of the metallic sulfide is high, and the anticollosion property is high, and therefore, the product is durable to a higher temperature than the case where the fatty acid metallic salt is used. Similarly to the fatty acid metallic salt, the metallic sulfide is better in the ductility than the perfluoro compound, so that the poor ductility of the fluorine compound can be supplemented. As for a usable metallic sulfide, there are molybdenum disulfide, tungsten sulfide or the like.

Also, it is possible to use a mixture of the above described metallic sulfide, fatty acid metallic salt and ionic perfluoroalkyl compound.

The description will be made as to the method of filling the pores with the solid lubricant. In addition to the above described method wherein the electrolysis is used for filling the ionic perfluoroalkyl compound, there is a three-electrolytic process wherein a metal is deposited through the electrolytic process in the fine pores in the anodic oxidation coating, then an opposite electric field is applied to the metal to dissolve it into the electrolyte, and the ion perfluoroalkyl compound is filled into the pores as if the compound replace it. By this three-electrolytic process, when the metal is dissolved, the metal fatty acid metallic salt or metallic sulfide can be produced if water soluble fatty acid or sulfide is added in the electrolyte, so that it is simultaneously filled into pores together with the perfluoroalkyl compound. This method is particularly desirable in that the amount of the filler is larger than by the method wherein the above described three solid lubricants are directly applied or a method wherein they are dissolved, and the roller is immersed thereinto.

Figure 3:
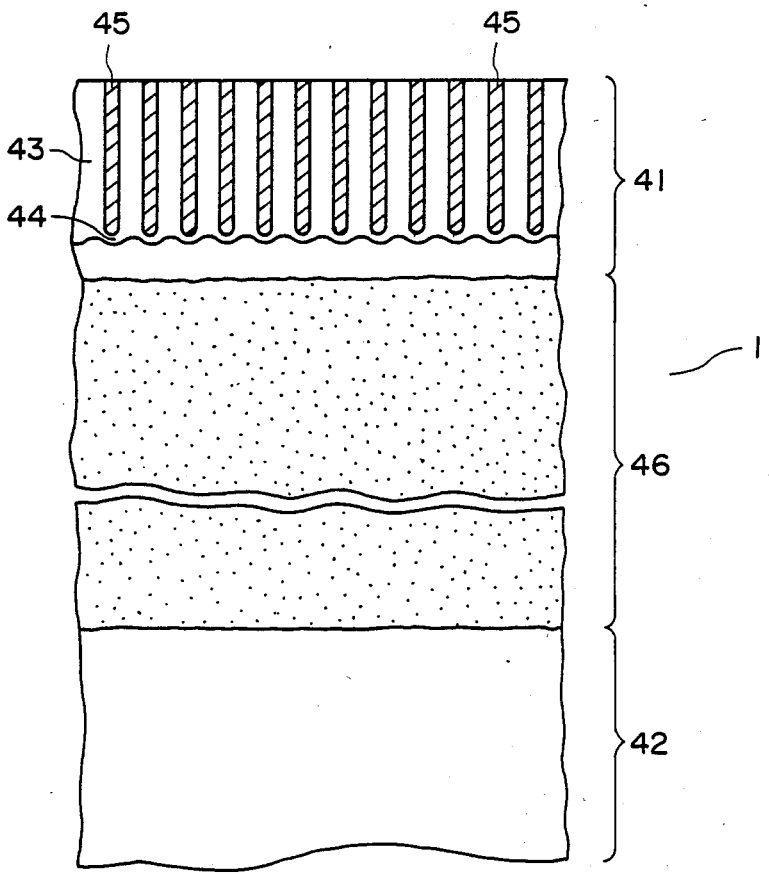
FIG. 3 is an enlarged view of a surface portion of an image fixing roller according to a further embodiment of the present invention.

Referring to FIG. 3, a further preferable embodiment of the present invention will be described. In this embodiment, the heating roller 1 comprises a hollow core metal 42 made of aluminum, aluminum alloy, copper or the like, a heat resistance layer 46 made of material having a low thermal conductivity on the core metal, an aluminum layer 41 as the surface layer evaporated or plated on the heat resistance layer, wherein the surface is anodized. This is used for the heating roller. Because the aluminum layer 41 is anodized, it covers the entire circumferential and longitudinal end surfaces of the heat resistance layer 46, and the thickness thereof is 50–100 microns.

The description will be made as to the aluminum layer 41 functioning as a surface material having a surface alumite layer 43 and as to the heat resistance layer 46. The heat resistance layer 46 has a thermal conductivity of one tenth - one hundredth of the alumite layer 43, and the material and the thickness thereof are determined depending on the operating temperature, the image fixing speed and a width of the nip formed between the heating roller and the pressing roller. Usable material is, for example, a heat resistance plastic material such as epoxy resin, silicone resin, polyimide, polyamide or the like which can be applied onto the core metal by dipping, molding, spraying or the like which are known. The usable materials have the thermal conductivity of 0.5–5.0 W/cm.deg. For example, when the fixing speed is 400 mm/sec with the nip width of 9 mm, and the toner to be fixed contain the resin containing as a major component polyester resin, the minimum fixing temperature is about 130° C., and therefore, the initial temperature of the fixing roller is set to 180° C. When the heat resistance layer 46 is made of epoxy resin and has a thickness of 100–150 microns, and the thickness of the surface layer 40 containing the aluminum layer has a thickness of 50 microns, it has been possible to continuously fix the images for not less than 250 sheets of A3 size (JIS). If, however, the thickness of the heat resistance layer 46 is not more than 50 microns, improper image fixing has been able to occur when about 100 A3 sheets are fixed. This is because the resistance to the heat conducting is not sufficient, and therefore, the heat is wasted into the image carrying member carrying the toner image. In this case, the heat resistance layer has a thickness not less than two-fold of that of the surface layer. However, if it is not less than twenty fold, the heat supply from the core metal 42 is retarded, and improper image fixing can result after only several tens sheets are fixed. Generally speaking, when the image fixing speed is increased or when the nip width is decreased, the amount of heat carried over to one sheet decreases, and therefore, it is preferable that the thickness of the heat resistance layer 46 is decreased or that the material exhibiting a higher heat conductivity is used. On the contrary, when the image fixing speed is decreased, or when the nip width is increased, it is preferable that the thickness of the heat resistance layer 46 is increased, or that the material having a lower heat conductivity is used.

The material of the heat resistance layer is selected so as to satisfy:

$$L/v \propto Ac/d$$

where v is an image fixing speed; L is a nip width; c is a heat conductivity of the heat resistance layer; d is a thickness of the layer; and A is a constant determined for the surface temperature of the roller, and therefore, is a constant if the surface temperature is the same.

In the foregoing descriptions, the heat resistance layer is made of a heat resistant (durable) resin, but it is possible to use a silicone rubber or the like added by silica, carbon or the like to increase the hardness thereof. As another material, there is a porous ceramic material which has a high heat resistance, when the porosity is properly controlled.

In the case of the rubber material, the layer may be formed by molding, injection or the like. In the case where the ceramic material is used, the porosity is changed by changing an amount of a binder during production, and therefore, a proper amount of the binder is mixed into the ceramic material, and it is applied on the core metal, whereafter it is sintered.

As described in the foregoing, according to the present invention, the surface of the heating roller is provided by anodizing an aluminum and by filling perfluoroalkyl compound into the fine pores of the anodized coating, whereby the hardness of the fixing roller surface is high, and therefore, the wear resistance is improved over the fluorine resin coated heating roller. The durability is not less than ten-folded.

Since the surface of the fixing roller is hardened, it is possible to increase the pressure of contact with the peeling member such as a separating pawl, and therefore, the jam occurrence rate has been significantly reduced.

Also, since the surface is of alumite having a high heat conductivity, the heat is efficiently transferred from the surface of the fixing roller to the toner image carrying material. Further, since the low thermal conductivity layer is provided between the surface material and the core metal, the heat is not extremely introduced. Thus, the energy loss is decreased at the time of the image fixing operation, and the toner offset to the fixing roller attributable to the extreme heating is reduced. The prevention of the excessive heat to the transfer material significantly reducing the occurrence of the curling of the image carrying material This further reduces the cause of the jam and improves the easiness of handing of the toner image carrying material.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a couple of rotatable rollers press-contacted to each other, for fixing a toner image by passing a toner image carrying material through a nip formed between said rotatable rollers;

at least one of said rollers including a surface coating of anodized aluminum having fine pores filled with perfluoroalkyl compound material.

2. An apparatus according to claim 1, wherein said one of the rollers is contactable to the toner image, said apparatus further comprising a member contacted to a surface of the one roller.

3. An apparatus according to claim 2, wherein said contacted member is a separating member for separating the toner image carrying material from said one of the rollers.

4. An apparatus according to claim 2, wherein said contacted member is a temperature sensor for sensing a surface temperature of said one of the rollers.

5. An apparatus according to claim 2, wherein said one of the rollers is heated by a heating source.

6. An apparatus according to claim 1, wherein the pores have a diameter of 100–500 Angstroms.

7. An apparatus according to claim 1, wherein said coating has a degree of opening of 5–40 % provided by the pores.

8. An apparatus according to claim 1, wherein the pores have a depth not less than 5 microns and less than 50 microns.

9. An apparatus according to claim 1, wherein not less than 80 % of the pores contain the perfluoroalkyl compound material filled from bottoms of the pores to tops thereof.

10. An image fixing apparatus, comprising:

a couple of rotatable rollers press-contacted to each other, for fixing a toner image by passing a toner image carrying material through a nip formed between said rollers;

at least one of said rollers including a surface coating of anodized aluminum having fine pores filled with perfluoroalkyl compound material and a material having a higher ductility than the perfluoroalkyl compound material.

11. An apparatus according to claim 10, wherein said one of the rollers is contactable to the toner image, said apparatus further comprising a member contacted to a surface of the one roller.

12. An apparatus according to claim 11, wherein said contacted member is a separating member for separating the toner image carrying material from said one of the rollers.

13. An apparatus according to claim 11, wherein said contacted member is a temperature sensor for sensing a surface temperature of said one of the rollers.

14. An apparatus according to claim 11, wherein said one of the rollers is heated by a heating source.

15. An apparatus according to claim 10, wherein the material having the higher ductility includes fatty acid metallic salt.

16. An apparatus according to claim 15, wherein a content of the perfluoroalkyl compound material is not less than 50 %.

17. An apparatus according to claim 10, wherein the material having the higher ductility includes a metal sulfide.

18. An apparatus according to claim 10, wherein the pores have a diameter of 100–500 Angstroms.

19. An apparatus according to claim 10, wherein said coating has a degree of opening of 5–40 % provided by the pores.

20. An apparatus according to claim 10, wherein the pores have a depth not less than 5 microns and less than 50 microns.

21. An image fixing apparatus, comprising:

a couple of rotatable rollers press-contacted to each other, for fixing a toner image by passing a toner image carrying material through a nip formed between said rollers;

at least one of said rollers including a surface coating of anodized aluminum having fine pores expanded after formation of the anodized coating, wherein the fine pores are filled with solid lubricant.

22. An apparatus according to claim 21, wherein said one of the rollers is contactable to the toner image, said apparatus further comprising a member contacted to a surface of the one roller.

23. An apparatus according to claim 22, wherein said contacted member is a separating member for separating the toner image carrying material from said one of the rollers.

24. An apparatus according to claim 22, wherein said contacted member is a temperature sensor for sensing a surface temperature of said one of the rollers.

25. An apparatus according to claim 21, wherein the fine pores have a size 2.5 or less times the size before expansion.

26. An apparatus according to claim 21, wherein the solid lubricant includes at least perfluoroalkyl compound material.

27. An apparatus according to claim 26, wherein a content of the perfluoroalkyl compound material is not less than 50 %.

28. An image fixing apparatus, comprising:

a couple of rotatable rollers press-contacted to each other, for fixing a toner image by passing a toner image carrying material through a nip formed between said rollers;

at least one of said rollers including a base member, a surface coating, on said base member, of anodized aluminum having fine pores filled with solid lubricant, a low heat conductivity layer provided between said base member and said anodized coating, and a heating source provided in said base member.

29. An apparatus according to claim 28, wherein said one of the rollers is contactable to the toner image, said apparatus further comprising a member contacted to a surface of the one roller.

30. An apparatus according to claim 29, wherein said contacted member is a separating member for separating the toner image carrying material from said one of the rollers.

31. An apparatus according to claim 29, wherein said contacted member is a temperature sensor for sensing a surface temperature of said one of the rollers.

32. An apparatus according to claim 28, wherein said low heat conductivity layer has a heat conductivity of not less than 0.5 and not more than 5.0 W/cm.deg.

33. An apparatus according to claim 28, wherein said low heat conductivity layer has a thickness not less than twice of that of said anodized coating.

34. An apparatus according to claim 28, wherein said low heat conductive layer is of a heat resistant resin.

35. An apparatus according to claim 28, wherein the pores have a diameter of 100–500 Angstroms.

36. An apparatus according to claim 28, wherein said coating has a degree of opening of 5–40 % provided by the pores.

37. An apparatus according to claim 26, wherein the pores have a depth not less than 5 microns and less than 50 microns.

* * * * *

UNITED STATES PATENT AND TRADEMARK OFFICE

CERTIFICATE OF CORRECTION

PATENT NO. : 4,887,964

DATED : December 19, 1989

INVENTOR(S) : TATSUO TAKEUCHI

It is certified that error appears in the above-identified patent and that said Letters Patent is hereby corrected as shown below:

COLUMN 2

Line 23, "handing" should read --handling--.
Line 53, "bodiment" should read --bodiments--.

COLUMN 3

Line 7, "thermister" should read --thermistor--.
Line 46, "acid both" should read --acid bath--.
Line 65, "compound," should read --compounds,--.

COLUMN 4

Line 1, "heating roll 1," should read --heating roller 1,--.
Line 52, "salt" should read --salts--.

COLUMN 5

Line 55, "contain" should read --contains--.

UNITED STATES PATENT AND TRADEMARK OFFICE

CERTIFICATE OF CORRECTION

PATENT NO. : 4,887,964

DATED : December 19, 1989

INVENTOR(S) : TATSUO TAKEUCHI

It is certified that error appears in the above-identified patent and that said Letters Patent is hereby corrected as shown below:

COLUMN 6

Line 48, "ten-folded." should read --ten-fold.--.
Line 64, "reducing" should read --reduces--.
Line 67, "handing" should read --handling--.

COLUMN 9

Line 5, "low heat conductive layer" should read --low heat conductivity layer--.

COLUMN 10

Line 4, "claim 26," should read --claim 28,--.

Signed and Sealed this

Fourth Day of June, 1991

*Attest:*

*Attesting Officer*

HARRY F. MANBECK, JR.

*Commissioner of Patents and Trademarks*